US009518442B2

(12) United States Patent
Xu et al.

(10) Patent No.: US 9,518,442 B2
(45) **Date of Patent: *Dec. 13, 2016**

(54) EASY DRILL SLIP WITH DEGRADABLE MATERIALS

(71) Applicant: Baker Hughes Incorporated, Houston, TX (US)

(72) Inventors: Richard Yingqing Xu, Tomball, TX (US); Zhiyue Xu, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 418 days.

This patent is subject to a terminal disclaimer.

(21) Appl. No.: 14/189,214

(22) Filed: Feb. 25, 2014

(65) Prior Publication Data

US 2014/0224506 A1 Aug. 14, 2014

Related U.S. Application Data

(63) Continuation-in-part of application No. 13/111,181, filed on May 19, 2011, now Pat. No. 8,695,714.

(51) Int. Cl.
*E21B 33/129* (2006.01)
*E21B 33/134* (2006.01)

(52) U.S. Cl.
CPC ..... *E21B 33/129* (2013.01); *E21B 33/134* (2013.01)

(58) Field of Classification Search
CPC .. E21B 33/129; E21B 33/134; E21B 33/1204; E21B 29/02
See application file for complete search history.

(56) References Cited

U.S. PATENT DOCUMENTS

| | | | | |
|---|---|---|---|---|
| 4,673,039 | A | 6/1987 | Mohaupt | |
| 6,167,963 | B1 | 1/2001 | McMahan et al. | |
| 6,494,261 | B1 | 12/2002 | Pahmiyer | |
| 6,708,768 | B2 | 3/2004 | Slup et al. | |
| 8,342,094 | B2 | 1/2013 | Marya et al. | |
| 2006/0213662 | A1* | 9/2006 | Creel | E21B 27/02 166/286 |
| 2007/0029084 | A1* | 2/2007 | Tong | E21B 33/134 166/255.1 |
| 2010/0276159 | A1 | 11/2010 | Mailand et al. | |
| 2011/0048743 | A1 | 3/2011 | Stafford et al. | |
| 2012/0125642 | A1 | 5/2012 | Chenault et al. | |
| 2012/0292053 | A1 | 11/2012 | Xu et al. | |

* cited by examiner

*Primary Examiner* — Giovanna C Wright
*Assistant Examiner* — Kristyn Hall
(74) *Attorney, Agent, or Firm* — Shawn Hunter

(57) ABSTRACT

Slip elements for a downhole tool include an inner body portion that is substantially formed of a material that is degradable by dissolution in response to a dissolving fluid and a hardened, resilient, radially outer contact portion. The inner body portion may be formed of magnesium, aluminum or iron based powder.

23 Claims, 7 Drawing Sheets

EASY DRILL SLIP WITH DEGRADABLE MATERIALS

BACKGROUND OF THE INVENTION

1. Field of the Invention

The invention relates generally to the design of slip elements that are used in gripping systems for downhole tools.

2. Description of the Related Art

Numerous downhole tools incorporate gripping systems that use one or more slips. The slips are moved radially outwardly against a surrounding tubular member in order to resist axial or torsional forces, or both. In many instances, slips are set to securely anchor a downhole tool in place within a surrounding tubular member. In other cases, such as with drag blocks, a slip may be set to merely resist axial or torsional movement. Downhole tools that incorporate gripping systems that use slips include, but are not limited to, packers, anchors, plugs, setting tools, bridge plugs, locks and fishing tools. Plugs, for example, have a plug body with slip elements that can be selectively moved radially outwardly to bitingly engage a surrounding tubular member. One type of plug is described in U.S. Pat. No. 6,167,963 issued to McMahan et al. That patent is owned by the assignee of the present application and is incorporated herein by reference.

Often, a downhole tool will need to be removed after it has been set, and this is usually done by milling through the tool. Unfortunately, milling through most conventional tool designs is costly and leaves large pieces which may be difficult to circulate out of the flowbore.

SUMMARY OF THE INVENTION

The present invention provides a design for a downhole tool wherein the slip elements of the gripping system include an inner body portion that is substantially formed of a material that is degradable by dissolution in response to a dissolving fluid and a hardened, resilient, radially outer contact portion. In described embodiments, the outer contact portion is substantially formed of a hardened material, such as cast iron, that is shaped to provide for biting into a surrounding tubular member. In described embodiments, the outer contact portion extends from the upper end of the slip element to the lower end of the slip element. Also in described embodiments, the outer contact portion includes a plurality of openings that function as stress risers.

In described embodiments, the inner body portion is substantially formed of a material that is dissolvable in response to a dissolving agent. In one current embodiment, the dissolvable material forming the inner body portion comprises magnesium-based composite powder compact. When the dissolvable material is magnesium-based powder compact, the dissolving agent may be potassium chloride (kcl). In preferred embodiments, the outer contact portion is formed of a material that either does not dissolve away in response to the dissolving agent or which dissolves at a significantly slower dissolution rate than that of the inner body portions.

As described, the slip inserts are cast within a surrounding molding to create a slip ring which can then be disposed onto the setting cone of the downhole tool. In described embodiments, the molding is a phenolic material which provides a laminate covering for the slip elements that protects the dissolvable material against premature dissolution.

In operation, the downhole tool is disposed into a flowbore and then set. When it is desired to remove the tool from the flowbore, a dissolving agent is used to dissolve away the inner body portions of the slip elements, thereby destroying the integrity of the gripping system of the tool. In some embodiments, a milling device is used to expose the dissolvable inner body portions to the dissolving agent. During removal of the tool by milling, the molding of the slip ring is ruptured by the mill, which exposes the dissolvable material forming the inner body portions to wellbore fluid which contains the dissolving agent. The dissolving agent dissolves away the inner body portions, leaving the outer contact portions of the slip elements. The presence of openings disposed through the outer contact portions assists in disintegration of the outer contact portions into smaller component parts via operation of the milling device. The outer contact portions, or portions thereof, and other components of the downhole tool may be circulated out of the wellbore via fluid returns.

According to other embodiments, removal of a slip member, including the outer contact portion and the inner body portions is done through degradation and dissolution when the slip member comes into contact with a dissolving agent. According to these embodiments, no milling is required. Dissolving agent is introduced into the wellbore and is brought into contact with the inner body portions. In these embodiments, the inner body portions are either not covered by a laminate or have openings disposed through the laminate that permits the dissolving agent to contact the inner body portions.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
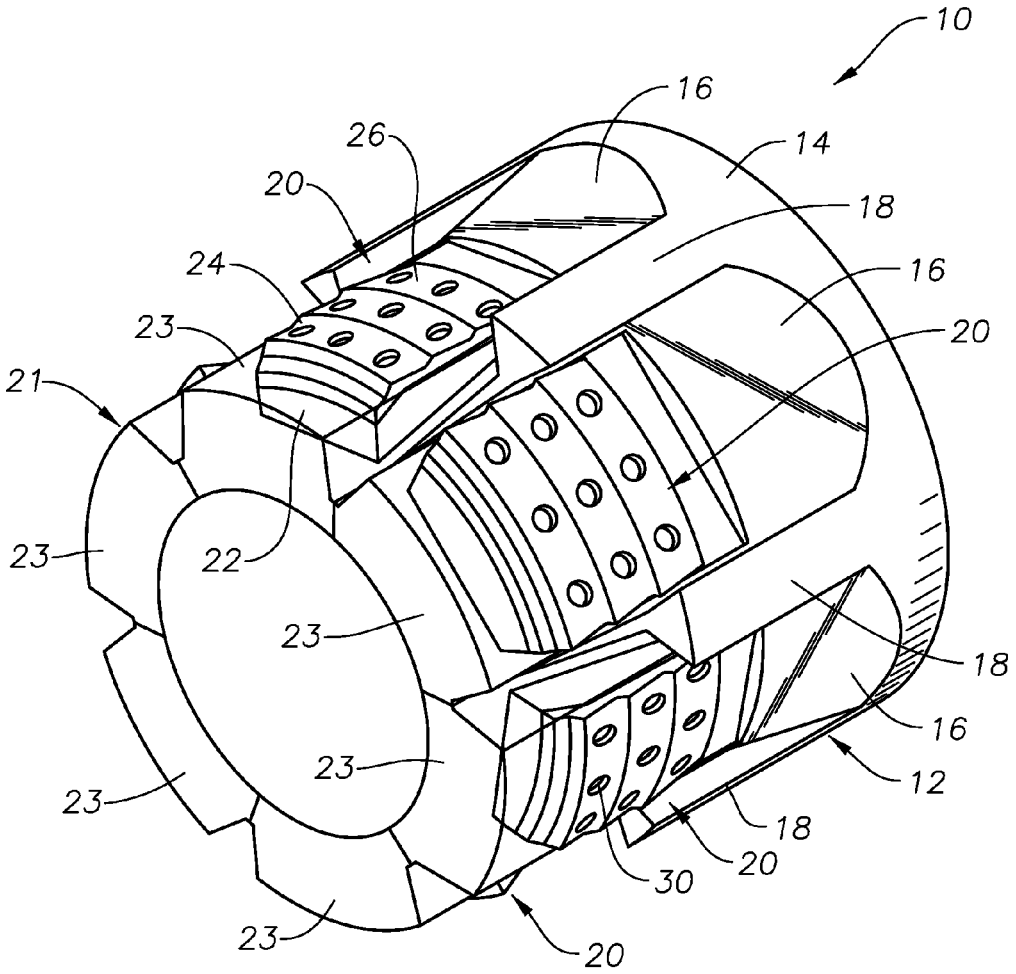
FIG. 1 is an isometric view of an exemplary downhole tool constructed in accordance with the present invention.

FIG. 1 depicts an exemplary downhole tool 10 constructed in accordance with the present invention. The tool 10 can be any of a class of devices that use radially moveable slip elements within a gripping system that resists axial or torsional forces. The downhole tools may include packers, anchors, plugs, setting tools, bridge plugs, locks and fishing tools. The downhole tool 10 includes a setting cone 12 which is generally cylindrical. The outer radial surface 14 of the setting cone 12 includes a plurality of angled ramps 16 which are separated by guides 18. A slip element 20, constructed in accordance with the present invention, is located upon each of the ramps 16.

Figure 6:
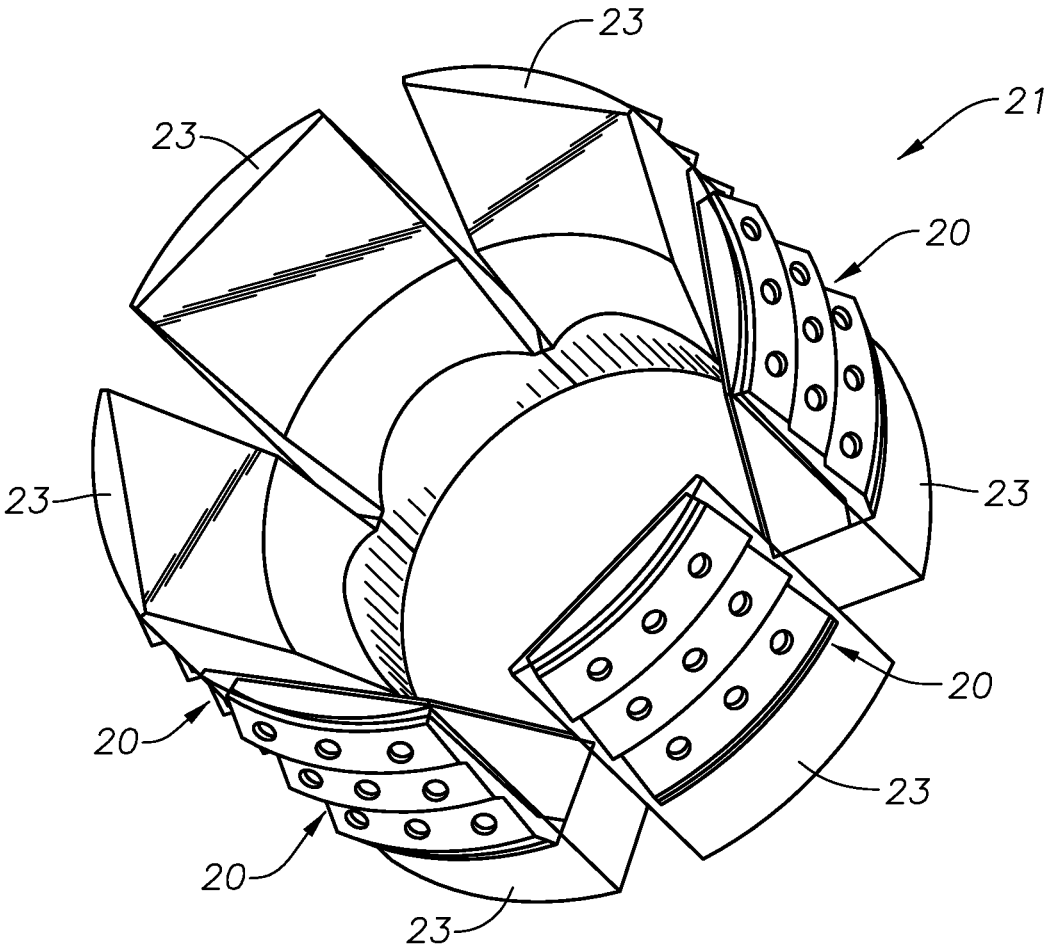
FIG. 6 is an isometric view of an exemplary slip ring which incorporates slip elements constructed in accordance with the present invention.

In preferred embodiments, the slip elements 20 are cast within a surrounding molding 21, which is best seen in FIG. 6. In particular embodiments, the molding 21 is formed of a phenolic resin and is cast in an annular ring shape having sheaths 23. The sheaths 23 each encase one of the slip elements 20. The molding 21 forms a slip ring which, as FIG. 1 illustrates, is disposed onto the setting cone 12.

The slip elements 20 are moveable upon the ramps 16 of the setting cone 12 between the retracted, unset position shown in FIG. 1 and a set position, wherein the slip elements 20 are moved upon the ramps 16, in a manner known in the art, radially outwardly with respect to the setting cone 12. In the set position, the slip elements 20 of the downhole tool 10 are brought into engagement with a surrounding tubular member.

Figure 2:
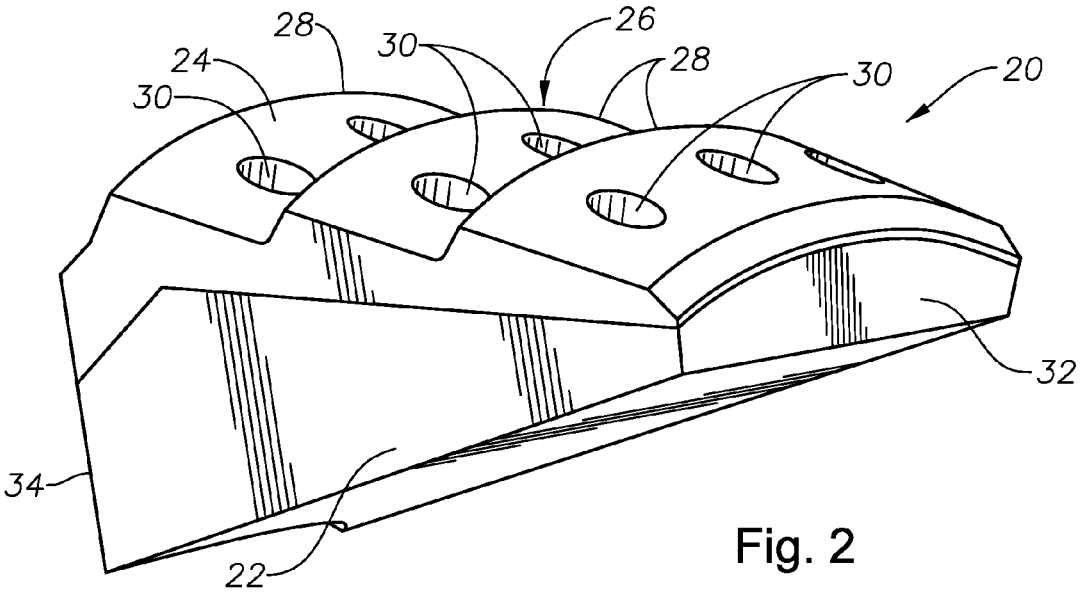
FIG. 2 is an isometric view of an exemplary slip element which is used with the tool shown in FIG. 1.
Figure 3:
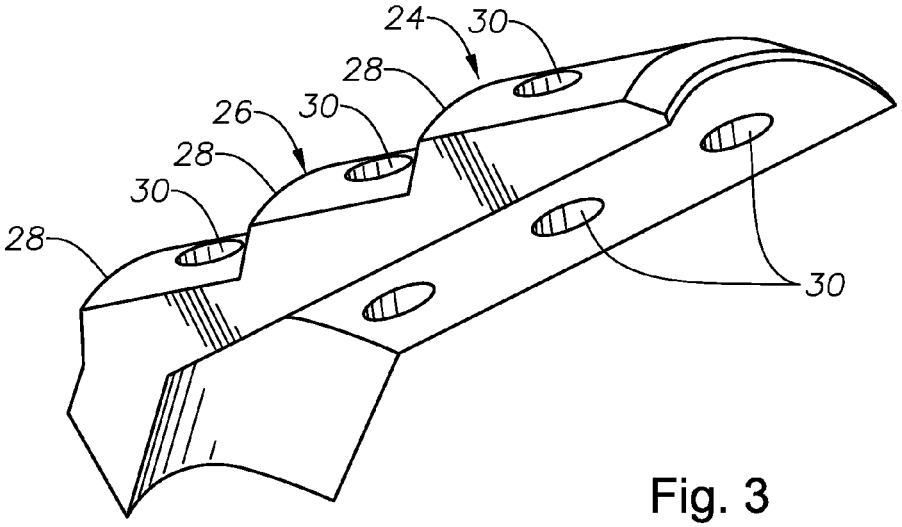
FIG. 3 is an isometric view of the exemplary outer contact portion of the slip element of FIG. 2.
Figure 4:
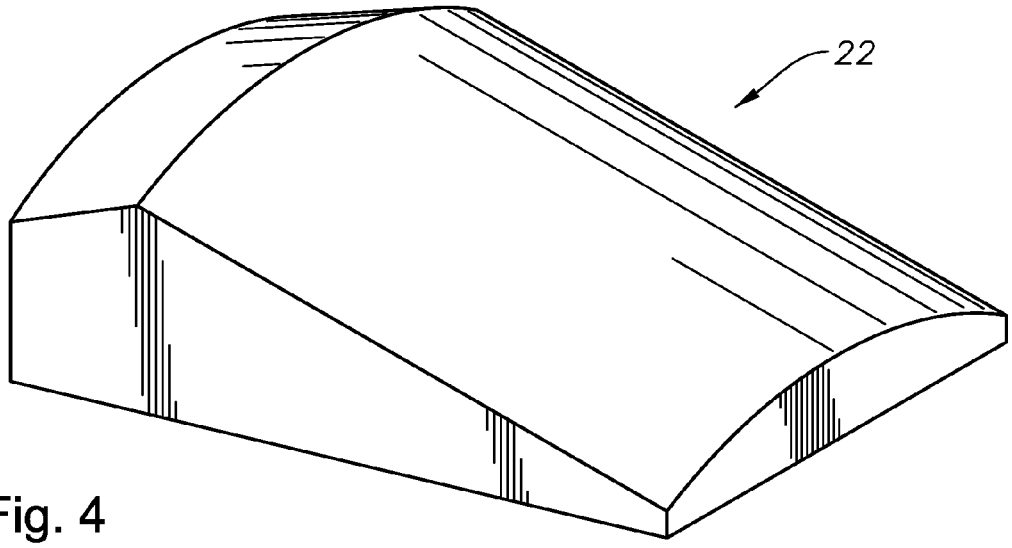
FIG. 4 is an isometric view of the exemplary inner body portion of the slip element of FIG. 2.
Figure 5:
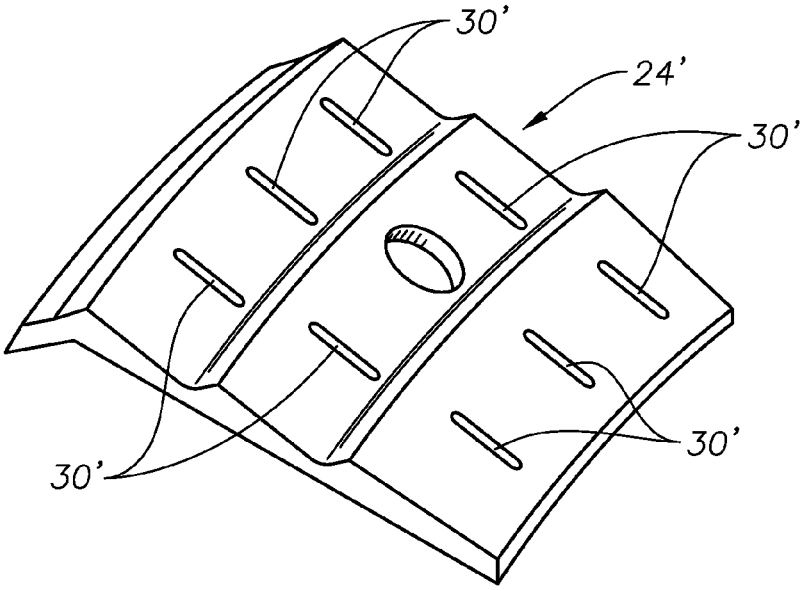
FIG. 5 is an isometric view of an exemplary alternative outer contact portion of the slip element in accordance with the present invention.

The structure of the slip elements 20 is better appreciated with reference to FIGS. 2 and 3. As FIG. 2 shows, the slip element 20 has a slip body which includes a radially inner body portion 22 and an outer contact portion 24. The inner body portion 22 is formed of a material that is substantially dissolvable in response to a dissolving agent. In one current embodiment, the inner body portion 22 is formed of magnesium-based composite powder compact. In other exemplary embodiments, the inner body portion 22 is formed of an aluminum-based or iron-based composite material. The magnesium, aluminum and iron-based composite materials may be a powder compact, a casting, a forging, an extruded component, or a laser additive 3D printed structure. FIG. 4 illustrates the inner body portion 22 apart from other components. The inner body portion 22 is generally wedge shaped. The inner body portion 22 may be formed by high-pressure compression at high temperatures. Thereafter, the part is shaped by known mechanical processes.

In instances wherein the dissolvable material is magnesium-based, aluminum-based or iron-based composite-powder compact, the dissolving agent may comprise various brines or acids often used in an oil or gas well. The brines include, but are not limited to, potassium chloride (kcl), sodium chloride (NaCl) and calcium chloride/calcium bromine (Ca2Cl/CaBr2). The acids include, but are not limited to, hydrogen chloride, acetic acid and formic acid. In particular embodiments, the dissolving agent is a solution that includes from about 2% to about 5% potassium chloride. In a particularly preferred embodiment, the dissolving agent is a solution that includes about 3% potassium chloride.

Also in these embodiments, the inner body portions 22 are entirely covered by the phenolic material forming the molding 21. As FIG. 1 illustrates, the contact surfaces 26 of the outer contact portions 24 may extend radially outside of the sheaths 23. This material acts as a laminate that separates the dissolvable material forming the inner body portion 22 from surrounding fluids which might contain one of more agents capable of dissolving the body portion 22.

FIG. 3 depicts the outer contact portion 24 apart from the body portion 22. The contact surface 26 of the contact portion preferably includes stepped wickers 28 formed thereupon to create a biting engagement with a surrounding tubular member. The outer contact portion 24 is preferably formed of a hardened material that is suitable for creating a biting engagement into a surrounding tubular or proximate metallic surface. In one preferred embodiment, the outer contact portion 24 is formed of cast iron. Also according to preferred embodiments, the outer contact portion 24 is substantially non-dissolvable by the dissolving agent that is used to dissolve the inner body portions 22.

Figure 9:
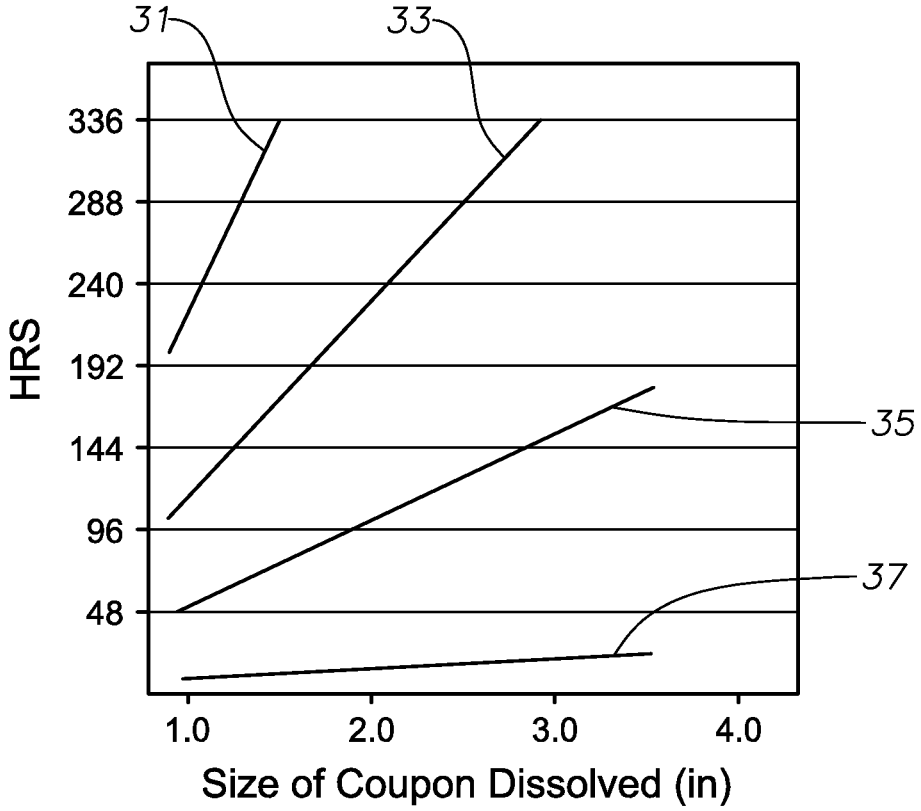
FIG. 9 is a chart illustrating exemplary dissolution rates of different compounds.

Alternatively, the outer contact portion 24 has a dissolution rate that is slower than that of the dissolvable material making up the inner body portion 22. In preferred embodiments, the outer contact portion 24 has a dissolution rate that is significantly slower than that of the inner body portion 22. A significantly slower rate of dissolution, as defined herein, is a dissolution rate that is more than ten times slower. FIG. 9 illustrates the dissolution of coupons of various materials over time in response to a dissolving agent. Disintegration (dissolution) of the coupon (in inches) is plotted against time in hours. Line 31 is representative of the dissolution rate of an aluminum-magnesium alloy. Line 33 is representative of the dissolution rate of a magnesium-tungsten alloy. Line 35 is representative of the dissolution rate of a magnesium-iron alloy. Line 37 represents the dissolution rate of magnesium-nickel alloy. It will be appreciated from reference to FIG. 9 that an aluminum-magnesium alloy has a faster dissolution rate than that of magnesium-tungsten, magnesium-iron or magnesium-nickel. In accordance with particular embodiments of the present invention, the outer contact portion 24 can be formed of a material that has a slower dissolution rate than that of the material making up the inner body portion 22. Therefore, the inner body portion 22 might be made up of, for example, magnesium-iron alloy if the outer body portion 24 is made up of magnesium-nickel alloy.

In certain embodiments, openings 30 are preferably formed through the outer contact portion 24. The openings 30 introduce points of weakness in the structure of the portion 24. Thus, they serve as stress risers which assist the outer contact portion 24 in disintegration during removal of the downhole tool 10 by drilling. FIG. 6 depicts an alternative embodiment for an outer contact portion 24' which has a similar construction to the outer contact portion 24. However, the openings 30' are in the form of elongated slots.

The contact portion 24 (or 24') preferably extends from the upper end 32 to the lower end 34 of the slip element 20. The outer contact portion 24 (or 24') is preferably affixed to the body portion 22 using a suitable adhesive.

Figure 10:
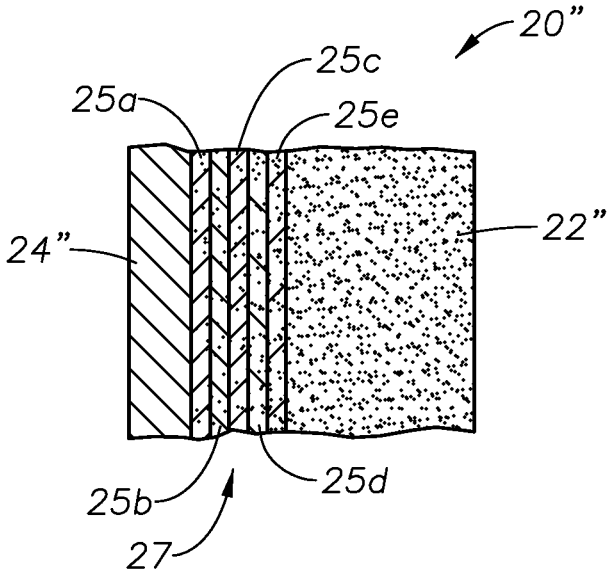
FIG. 10 is cross-sectional schematic depiction of an integrally-formed slip element in accordance with the present invention.

According to alternative embodiments, the outer contact portion and the inner body portion of a slip element are integrally formed. FIG. 10 is a schematic cross-section of an exemplary slip element 20" that is made up of an inner body portion 22" and an outer contact portion 24". Because the slip element 20" is integrally formed, the inner body portion 22" and the outer contact portion 24" are interconnected by a transition gradient zone 23. Layers 25*a*, 25*b*, 25*c*, 25*d* and 25*e* are overlayed upon each other. Collectively, the layers 25*a*, 25*b*, 25*c*, 25*d* and 25*e* make up a transition gradient zone 27 that interconnects the inner body portion 22" and the outer contact portion 24". The slip element 20" may be manufactured by use of 3-D laser printing systems of a type known in the art. According to an exemplary method of manufacture, multiple layers of material are deposited onto a substrate that corresponds to the outer contact portion 24". The layers 25*a*, 25*b*, 25*c*, 25*d* and 25*e* contain various proportions of the materials making up the outer body portion and the inner body portion. FIG. 10 shows a layer 25*a* having a composition that is about 75% of the material used to form the outer contact portion 24" and about 25% of the material used to form the inner body portion 22". Layer 25*b* has a composition that is about 60% of the material forming the outer contact portion 24" and about 40% of the material forming the inner body portion 22". Layer 25*c* has a composition that is about 50% of outer contact portion material and about 50% of inner body portion material. Layer 25*d* is made up of about 60% of inner body portion material and about 40% of outer contact portion material. Layer 25*e* is made up of about 75% inner body portion material and about 25% of outer contact portion material. There may be more or fewer than five layers within the transition gradient zone 27, as desired. The transition gradient zone 27 serves to transition the material of the slip member 20" from one to the other in a graded manner. FIG. 10 is not to scale or in proportion as it is for illustrative purposes only. According to particular embodiments, the transition gradient zone 27 may have an actual thickness that is from about 10 microns to about 1000 microns.

In operation, the tool 10 is run into a flowbore and then moved from its unset position to a set position, in a manner known in the art. The outer contact portions 24 (or 24') of the slip elements 20 engagingly contact the surrounding tubular member.

Figure 8:
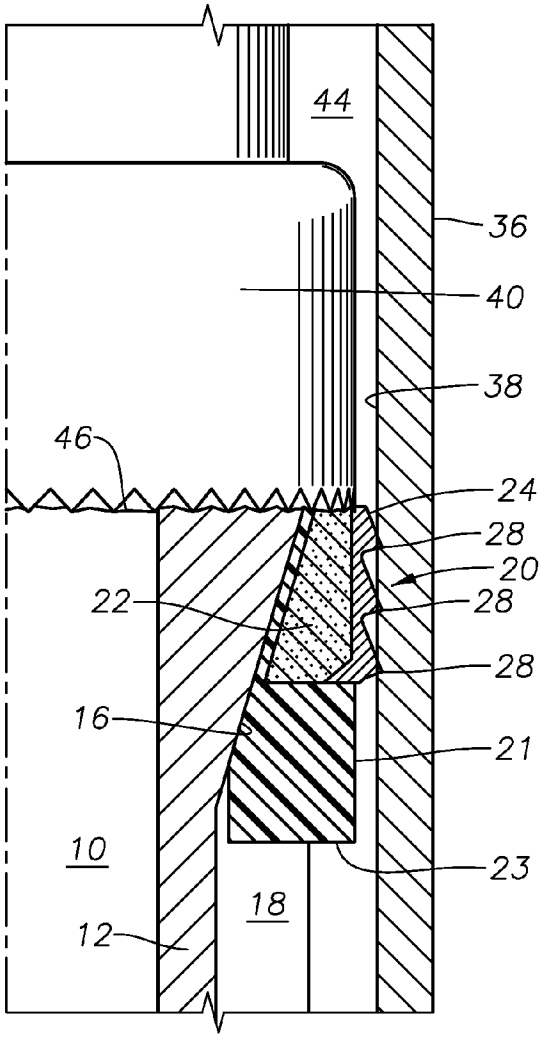
FIG. 8 is a one-quarter side cross-sectional view depicting removal by milling of an exemplary downhole tool from the surrounding tubular in accordance with the present invention.
Figure 7:
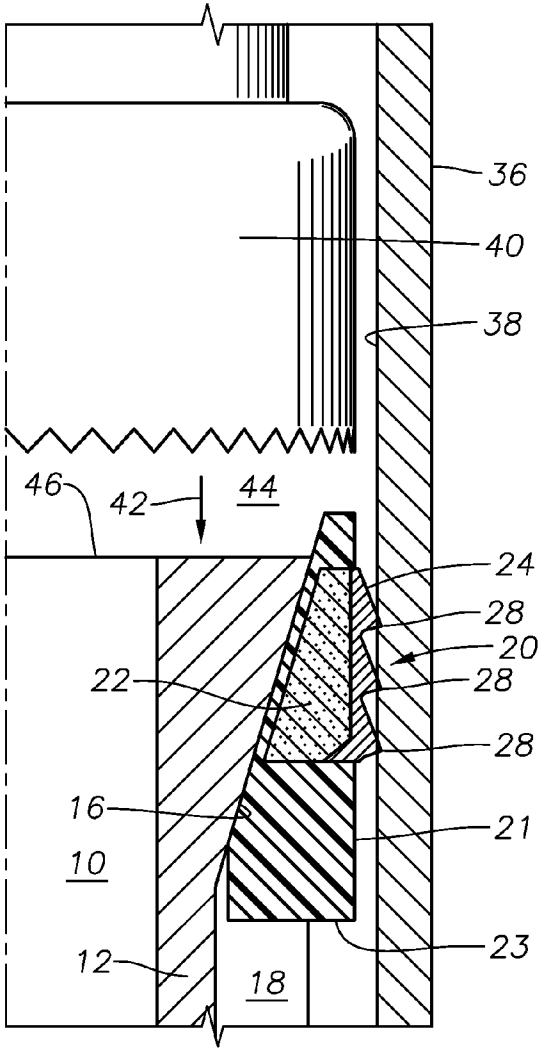
FIG. 7 is a one-quarter side cross-sectional view depicting an exemplary downhole tool in accordance with the present invention secured within a surrounding tubular.

When it is desired to remove the tool 10 from the flowbore, a drilling or milling device, of a type known in the art, contacts the tool 10 and begins to destroy it by grinding action. FIG. 7 illustrates the tool 10 having been set within a surrounding tubular member 36 such that the wickers 28 of the slip elements 20 (one shown) are set into the interior surface 38 of the tubular member 36 in an engaging contact. A milling device 40 is disposed within the tubular member 36 and moved in the direction of arrow 42 through flowbore 44 toward engagement with the upper end 46 of plug 10. As FIG. 8 shows, the milling device 40 then engages and begins to mill away or remove the upper end 46 of the downhole tool 10. The setting cone 12 is abraded away. As the milling device 40 encounters the slip elements 20, the phenolic material forming the slip ring molding 21 is milled through, as depicted, thereby exposing the inner body portions 22 to fluid within the flowbore 44. Dissolving agent is present in the fluid within the flowbore 44 and acts to dissolve the inner body portions 22 within the wellbore fluid. It is noted that potassium chloride in solution is typically present in conventional drilling fluids. In addition, the milling tool 40 will mill away the outer contact portions 24, and rupture the outer contact portions 24 into smaller component pieces due to the pattern of openings 30 which are disposed through the outer contact portions 24. The design of the slip inserts 20 will permit the downhole tool 10 to be rapidly removed from the flowbore 44. In addition, a number of the components of the tool 10 can be more easily circulated out of the flowbore 44.

Figure 11:
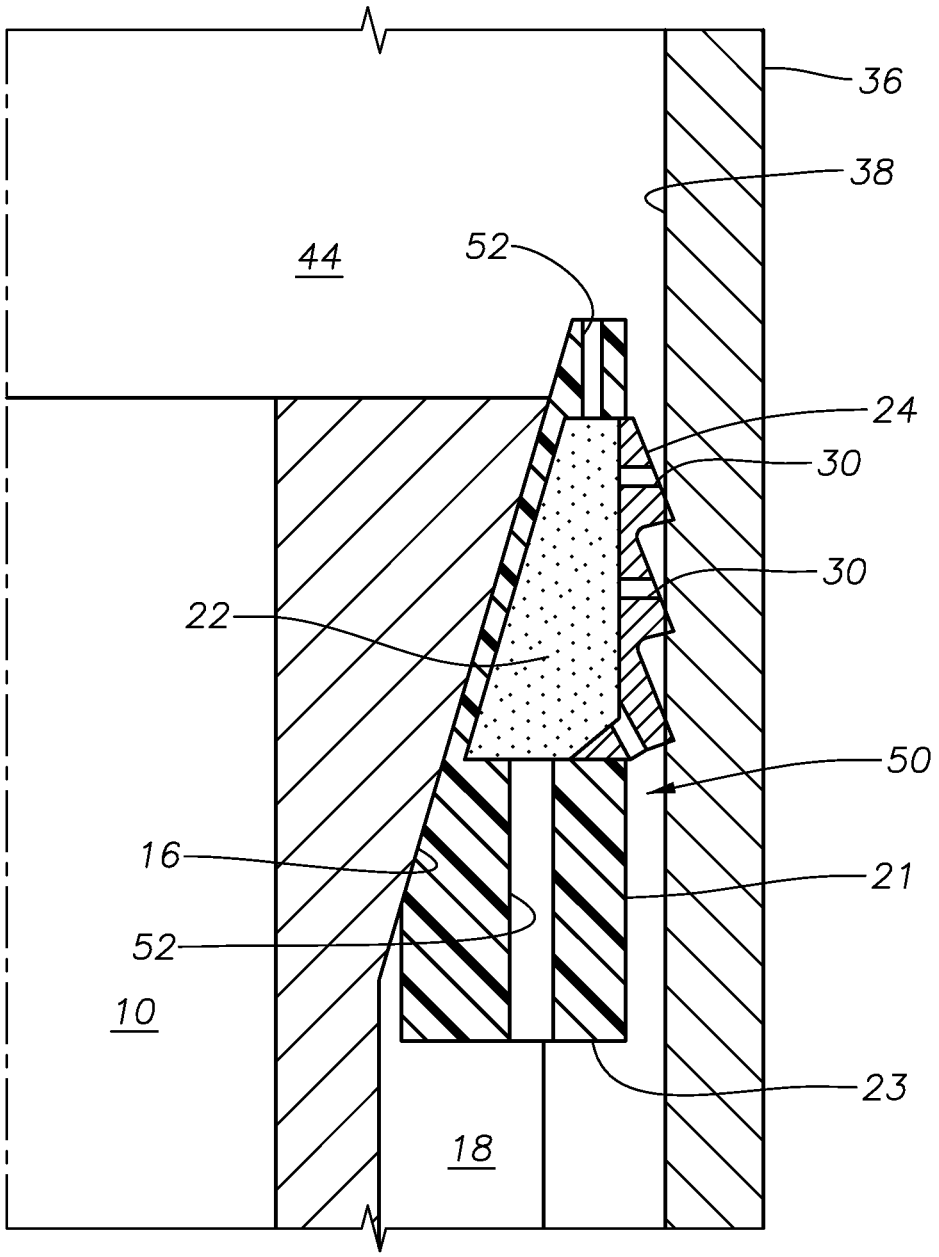
FIG. 11 is a side, cross-sectional view of an alternative exemplary slip element constructed in accordance with the present invention.

An alternative embodiment of the invention, features a slip element (50 in FIG. 11) which does not require milling or physical abrasion of the slip element in order to destroy the slip element. FIG. 11 illustrates the slip element 50 in a set position within tubular member 36. Except where indicated to the contrary, the slip element 50 is constructed and operates in the same manner as the slip element 20 described earlier. Openings 52 are disposed through the molding 21 and allow for fluids in the flowbore 44 to be in fluid communication with the inner body portion 22 of the slip member 50. In alternative embodiments, some or all of the molding 21 is removed from surrounding the inner body portion 22. In order to destroy the slip element 50, and thereby release a downhole tool from being set within the flowbore 44, a dissolving agent is circulated into the flowbore 44 proximate the slip element 50 and will dissolve away the inner body portion 22. This will destroy the integrity of the slip element 50 and permit a downhole tool incorporating the slip element 50 to be released from engagement from the surrounding tubular 36.

Those of skill in the art will recognize that numerous modifications and changes may be made to the exemplary designs and embodiments described herein and that the invention is limited only by the claims that follow and any equivalents thereof.

What is claimed is:

1. A slip element comprising:

an inner body portion that is formed of a dissolvable material that is dissolvable in response to a dissolving agent; and an outer contact portion in contact with the inner body portion and being formed of a material suitable to provide engaging contact with a tubular member near the outer contact portion and that is not dissolvable by the dissolving agent or dissolvable at a slower dissolution rate relative to the dissolvable material.

2. The slip element of claim 1 wherein the dissolvable material comprises magnesium-based, aluminum-based or iron-based composite.

3. The slip element of claim 2 wherein the dissolving agent is from the group consisting of potassium chloride, sodium chloride, calcium chloride, calcium bromine, hydrogen chloride, acetic acid and formic acid.

4. The slip element of claim 1 further comprising a laminate to preclude premature dissolution of the inner body portion.

5. The slip element of claim 1 wherein the inner body portion and the outer contact portion are affixed to each other by an adhesive.

6. The slip element of claim 1 wherein the inner body portion and the outer contact portion are interconnected by a transition gradient zone.

7. The slip element of claim 1 further comprising a plurality of openings formed through the outer contact portion.

8. The slip element of claim 1 wherein the slip element is incorporated within a gripping system for a downhole tool having a plurality of slip elements.

9. The slip element of claim 8 wherein the downhole tool comprises a packer, anchor, plug, setting tool, bridge plug, lock or fishing tool.

10. The slip element of claim 1 wherein the inner body portion presents a first axial end and a second axial end that is opposite the first axial end and wherein:

the outer contact portion extends from the first axial end to the second axial end.

11. A downhole tool having a gripping system for resisting axial or torsional movement within a flowbore of a surrounding tubular, the gripping system comprising:

a setting cone;

a slip element that is selectively radially moveable with respect to the setting cone between unset and set positions, the slip element comprising:

an inner body portion formed of a dissolvable material that is dissolvable in response to a dissolving agent; and an outer contact portion in contact with the inner body portion and being formed of a material suitable to provide engaging contact with a tubular member near the outer contact portion and that is not dissolvable by the dissolving agent or dissolvable at a slower dissolution rate relative to the dissolvable material.

12. The downhole tool of claim 11, wherein the inner body portion further comprises a laminate to preclude premature dissolution of the inner body portion.

13. The downhole tool of claim 11 wherein the dissolvable material comprises magnesium-based, aluminum-based or iron-based composite.

14. The downhole tool of claim 13 wherein the dissolving agent is from the group consisting of potassium chloride, sodium chloride, calcium chloride, calcium bromine, hydrogen chloride, acetic acid and formic acid.

15. The downhole tool of claim 11 wherein the inner body portion and the outer contact portion are affixed to each other by an adhesive.

16. The downhole tool of claim 11 wherein the inner body portion and the outer contact portion are interconnected by a transition gradient zone.

17. The downhole tool of claim 11 wherein the inner body portion presents a first axial end and a second axial end that is opposite the first axial end and wherein:

the outer contact portion extends from the first axial end to the second axial end.

18. The downhole tool of claim 11 wherein the outer contact portion further comprises a plurality of openings formed therethrough.

19. The downhole tool of claim 11 wherein there is a plurality of said slip elements.

20. The downhole tool of claim 11 wherein the downhole tool comprises a packer, anchor, plug, setting tool, bridge plug, lock or fishing tool.

21. A method of releasing a downhole tool that is set within a flowbore from the flowbore, comprising the steps of:

a) providing a set downhole tool having:

a setting cone;

a slip element that is selectively radially moveable with respect to the setting cone between unset and set positions, the slip element comprising:

an inner body portion formed of a dissolvable material that is dissolvable in response to a dissolving agent;

an outer contact portion in contact with the inner body portion and being formed of a material suitable to provide engaging contact with a tubular member near the outer contact portion, the material forming the outer contact portion being not dissolvable by the dissolving agent or dissolvable at a slower dissolution rate relative to the dissolvable material; and b) flowing a dissolving agent within the flowbore to dissolve the inner body portion.

22. The method of claim 21 further comprising the steps of:

engaging a top portion of the downhole tool with a milling device; and removing a portion of molding surrounding the inner body portion to at least partially expose the inner body portion to the flowbore and the dissolving agent.

23. A method of setting a downhole tool with a gripping system having the slip element of claim 1, the method comprising the step of moving the slip element with respect to a ramp of a setting cone to cause the slip element to be urged radially outwardly into gripping engagement with a surrounding tubular.

* * * * *